US008245876B2

(12) United States Patent
Gehring et al.

(10) Patent No.: US 8,245,876 B2
(45) Date of Patent: Aug. 21, 2012

(54) WIPES CONTAINER

(75) Inventors: Debra Gay Gehring, Cincinnati, OH (US); Mario Alonso, Loveland, OH (US); Angela C. Oehlerking, Cincinnati, OH (US); Catherine Lazar Odell, Portland, OR (US); Paul Francis O'Connor, Portland, OR (US); Christine Lee Enderby, Portland, OR (US); David R. Knaub, Portland, OR (US)

(73) Assignee: The Procter & Gamble Company, Cincinnati, OH (US)

( * ) Notice: Subject to any disclaimer, the term of this patent is extended or adjusted under 35 U.S.C. 154(b) by 359 days.

(21) Appl. No.: 12/503,460

(22) Filed: Jul. 15, 2009

(65) Prior Publication Data

US 2011/0011767 A1 Jan. 20, 2011

(51) Int. Cl.
*B65H 3/00* (2006.01)

(52) U.S. Cl. ..... 221/41; 221/64; 221/65; 221/37

(58) Field of Classification Search ..... 221/61, 221/64, 65, 33, 37, 41, 308, 309
See application file for complete search history.

(56) References Cited

U.S. PATENT DOCUMENTS

| | | | | |
|---|---|---|---|---|
| 3,868,052 | A | 2/1975 | Rockefeller et al. | |
| 3,982,650 | A * | 9/1976 | Ichihara | 220/4.28 |
| 4,817,832 | A * | 4/1989 | Nagy | 222/530 |
| 5,230,442 | A * | 7/1993 | Dean, Jr. | 222/108 |
| 5,263,607 | A * | 11/1993 | Temesvary et al. | 221/304 |
| D443,508 | S | 6/2001 | Braaaten | |
| 6,412,656 | B1 * | 7/2002 | Placik | 221/33 |
| 6,834,773 | B2 | 12/2004 | Wu | |
| 6,910,579 | B2 * | 6/2005 | Reinke et al. | 206/494 |
| 2003/0234257 | A1 * | 12/2003 | Tumlinson | 221/34 |
| 2008/0083774 | A1 | 4/2008 | Sawin et al. | |
| 2008/0222929 | A1 | 9/2008 | Sawin et al. | |
| 2008/0223868 | A1 | 9/2008 | Sawin et al. | |
| 2009/0050504 | A1 | 2/2009 | Stechschulte et al. | |

OTHER PUBLICATIONS

PCT International Search Report, PCT/US2010/041946 date of mailing Apr. 10, 2010.

* cited by examiner

*Primary Examiner* — Timothy Waggoner
(74) *Attorney, Agent, or Firm* — John G. Powell

(57) ABSTRACT

A container for storing and dispensing wipes that includes an extendable orifice. The orifice is extendable into the storage space of the wipes container to position an opening in close proximity with the top of a stack of wipes stored in the container. The extendable orifice may also act to reduce moisture loss in the case of wet-wipes and reduce the occurrence of fall-back.

20 Claims, 10 Drawing Sheets

WIPES CONTAINER

FIELD OF THE INVENTION

A container for storing and dispensing wipes is disclosed. Specially, there is disclosed a wipes container that includes an extendable orifice for enabling a user to access wipes stored in the wipes container.

BACKGROUND OF THE INVENTION

Wipes are widely known to be useful to for removing contaminants from a variety of surfaces and/or applying compositions to a variety of surfaces. Wipes are commonly sold in containers or tubs designed to store a plurality of wipes in an interior storage space and to dispense the wipes individually through an orifice in the top of the container. The wipes may be stored in a tub, e.g., as an interleaved stack, so that when a wipe is removed from the tub, another wipe will at least partially extend through the orifice. In this way, a user is able to access the next wipe in the stack without having to open the container. In conventional wipes tubs, the orifice is generally stationary. That is, the orifice cannot be easily repositioned in relation to the wipes inside the container, and as the supply of wipes is depleted, the distance between the orifice and the top of the stack of wipes increases. In the event that a wipe falls back inside the wipes container, it may be difficult for a user to access the wipe through the orifice. As the distance between the orifice and the top of the wipe stack increases, it may become more difficult for a user to access a wipe that has fallen back into the container. Thus, to ensure a wipe is desirably positioned for use, a user may have to undesirably open the wipes container and manually position the next wipe in the orifice. Despite the efforts of manufacturers to eliminate fall-back in wipes containers, the phenomenon continues to be a problem in the industry.

In addition to the problem of fall-back, another undesirable aspect of some conventional wipes containers is the inability to prevent moisture loss. Some wipes include a benefit composition containing water (e.g., wet-wipes) and/or one or more volatile component(s) such as alcohol. The water, in the form of water vapor, and/or the volatile component(s) typically occupy the so-called free space inside the wipes container. If a wipes container is not properly sealed, the water vapor and/or volatile components may escape from the container to the external environment and reduce the beneficial effects of the benefit composition. Some conventional wipes tubs may include a lid to cover the orifice, and thereby reduce the area through which the moisture can escape. The lid may be configured to fit against a seal or gasket to further reduce the area around the edges of the lid through which moisture or other volatile components can escape. Additionally, manufacturers may make the containers out of a water and/or vapor impermeable material (e.g., injection molded polyolefin). However, despite such efforts, the lid must be opened at least occasionally in order to access a wipe. When the lid is opened, the water vapor and/or volatile components present in the interior storage space may escape. If the lid is left open (e.g., inadvertently or to keep from having to reopen the wipes container during the performance of another task such as a diaper change), then the amount of water vapor and/or volatile component(s) that escape from the tub may increase. As the stack of wipes in a wipes container becomes depleted and the amount of free space in the interior storage space increases, there is more space for water vapor and/or volatile components to occupy.

Yet another undesirable feature sometimes associated with disposable wiping products is the effect of chaining. Chaining is generally recognized as the failure of two or more wipes to separate when a wipe is extracted from the container, thereby forming a chain of extracted wipes. When chaining occurs, the undesired wipe(s) that are extracted from the container must typically be used, discarded or put back into the container. Using or discarding the undesired wipes may result in undesirable waste or inconvenience. For example, when changing a diaper on a child, the caregiver of the child may have one hand occupied with the child, dirty diaper, or other task. By pulling more than one wipe out of the container, the caregiver must now make a choice to either use all of the extracted wipes at one time or to separate the wipes. Separating the wipes with only one hand may require placing at least some of the undesired wipes on a surface that is potentially polluted with dirt, bodily waste, or any number of other contaminants. Putting the undesired wipes back into the container, especially in instances where a user only has one available hand, may result in further inconvenience.

Accordingly, it would be desirable to provide a wipes container that reduces the likelihood of fall-back. It would also be desirable to provide a wipes container that reduces the likelihood of water vapor and/or volatile components escaping from the wipes container. It would further be desirable to provide a wipes container with an extendable orifice. It would yet further be desirable to provide wipes container with an extendable orifice that can provide a space for storing unused wipes.

SUMMARY OF THE INVENTION

In order to provide a solution to aforementioned problems, a container for storing and dispensing wipes is disclosed herein. The wipes container includes an interior storage space for storing one or more wipes and having one or more wipes disposed in the interior storage space. The wipes container also includes an extendable orifice for enabling a user to access the wipes stored in the interior storage space. The extendable orifice has an x-y plane, and the extendable orifice is extendable into the interior storage space of the wipes container in an axial-direction that is substantially orthogonal to the x-y plane.

DETAILED DESCRIPTION OF THE INVENTION

Definitions

Figure 1:
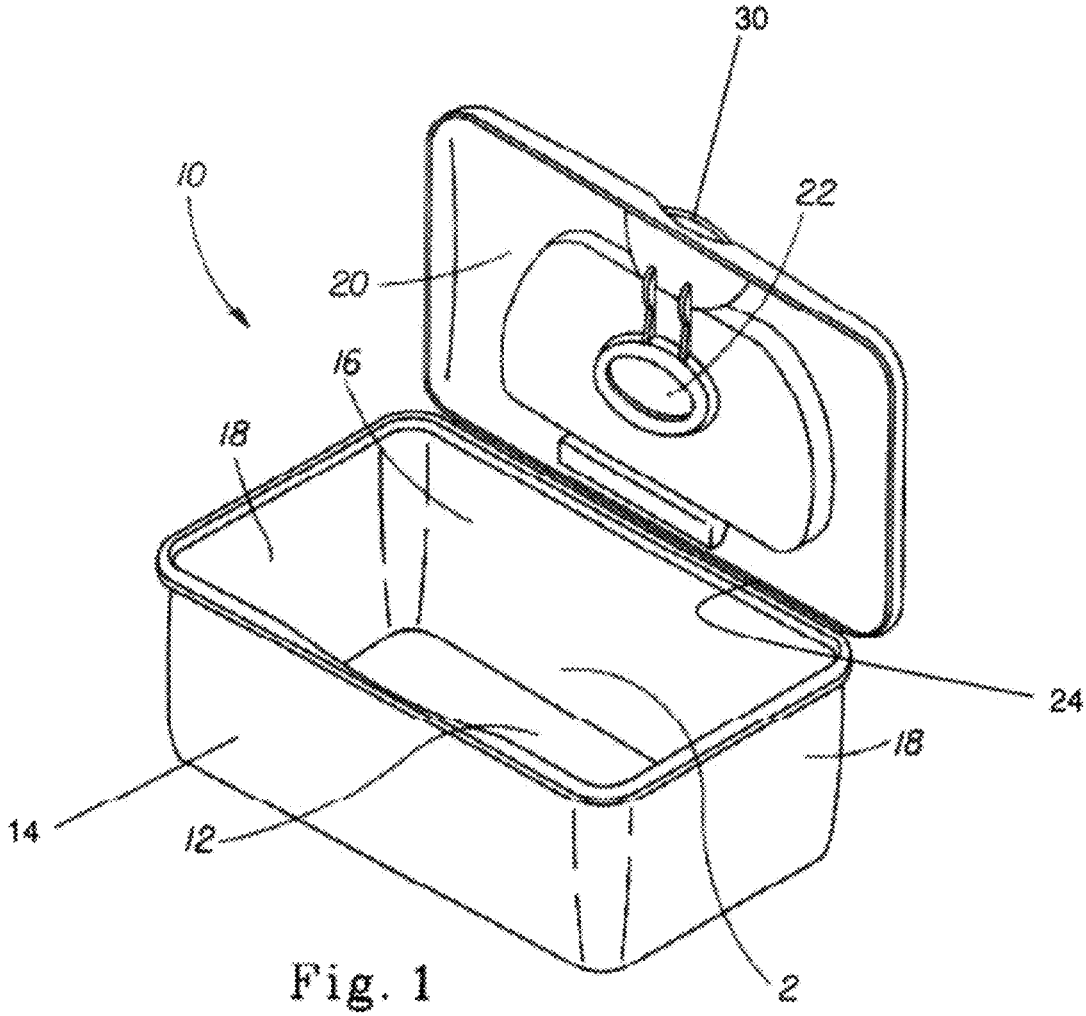
FIG. 1 is a perspective view of a wipes container.

"Dispensing Force" means the force needed to extract an individual wipe through an orifice in the wipes container, when the wipe is extracted as intended by the manufacturer of the wipes container.

"Disposed" and variations thereof, mean the placement or position of one element relative to another element, where the elements are connected to or in physical contact with one another. For example, when a first element is disposed on a second element, the first and second elements may be joined together or formed together to provide an integral or unitary article. A first element may also be disposed on a second element when the first element is applied to the second element, for example, by a printing method or a coating method.

"Extendable" means an article or article component is able to be increased in one or more dimensions (e.g., length, width, area, and/or volume) without damage to the component or surrounding components or substantial degradation of performance that would impair the continued use of an article comprising the extendable component. Unless otherwise indicated herein, "extended" includes partially and fully extended articles and/or components. "Collapsible" means an article or article component that has been extended is able to be decreased in the extended dimension (e.g., length, width, area, and/or volume) using substantially the same mechanism of operation that was used to extend the article or component. It will be appreciated that an extendable/collapsible component need not have an infinite life span, but it is sufficient that the an component can be extended and collapsed successively several times over the typical use life span of the component and/or article comprising the component. Nonlimiting examples of extendable/collapsible articles or components of articles are certain kinds of telescopes, a bellows for an accordion, a bellows for a camera, antennas used with certain kinds of portable radios and car radios. "Telescopically extendable/collapsible" means an article or component is able to extend/collapse similar to the manner in which a telescope extends/collapses (i.e., multiple segments configured to pass lengthwise out of one another or into one another).

"Joined" means the attachment together of two or more components, either by direct affixment of a first element to a second element or by affixment of the first element to an intermediate element which is affixed to the second element.

"Lift-off" occurs when a container is lifted off of the surface upon which it was placed as a result of extracting a wipe from the container. For example, a wipes container, which has been placed on the surface of an ordinary table, exhibits lift-off when a user who is attempting to extract a wipe from the wipes container, using only one hand, lifts at least a portion of the container off of the surface of the table while extracting the wipe.

"Moisture impermeable" means that an element resists and, ideally, prevents the passage of liquid and/or gaseous compositions (e.g., water and/or water vapor) from one side of the element to the opposing side of the element. For example, a wipes container for storing wet-wipes will typically include one or more moisture impermeable walls that prevent the passage and/or penetration of water through the wall of the wipes container in order to prevent or at least delay moisture loss from the wet-wipes.

"Reattachable" means a component(s) of an article or portions of a component can be separated from the article and/or component and rejoined to the article and/or component or another substantially similar article and/or component, successively without damage to surrounding components or substantial degradation of performance, which would impair the continued use of the article and/or component.

"Removable" means a component of an article can be separated from the article or another component such that there is little or no damage to the component(s), the article, and/or the surrounding components, which would impair the use of the article or any component thereof.

"Transferable" means a removable and/or reattachable element that is intended to be transferred from a first location to a second location. For example, an extendable orifice that is removable is removed from a first container and joined to a second container for use with the second container.

"Rigid" means a component is relatively inflexible (i.e., not extendable or collapsible). A rigid component or article may be formed from rigid material or flexible material. When formed from flexible material, a rigid component or article may be structurally modified to be rigid (e.g., by adding a stiffening component).

"Wipe" means a fibrous substrate such as, for example, a nonwoven used for cleaning skin and other surfaces. "Wet-wipe" refers to a wipe that includes more than 10% of a liquid composition by weight based on the weight of the wet-wipe. The liquid composition may be impregnated into the wipe or the liquid composition may be fugitive (i.e., free to move from one portion of the wet-wipe to another portion of the wet-wipe, or even from one wet-wipe to another wet-wipe).

Various types of disposable wiping products such as, for example, wipes, facial tissues, bath tissues, paper towels, and napkins are commonly used by consumers. Such wiping products can include dry products or saturated or pre-moistened wiping products. Saturated or pre-moistened wiping products are used in a variety of different wiping and polishing applications. Pre-moistened wipes sold in a stack of individual, folded wiping products may be treated with an antibacterial agent and packaged as sanitary wipes. Whether the wiping products are wet or dry, it may be desirable to provide a container for storing and dispensing the wiping products.

Wipes Container.

Figure 2:
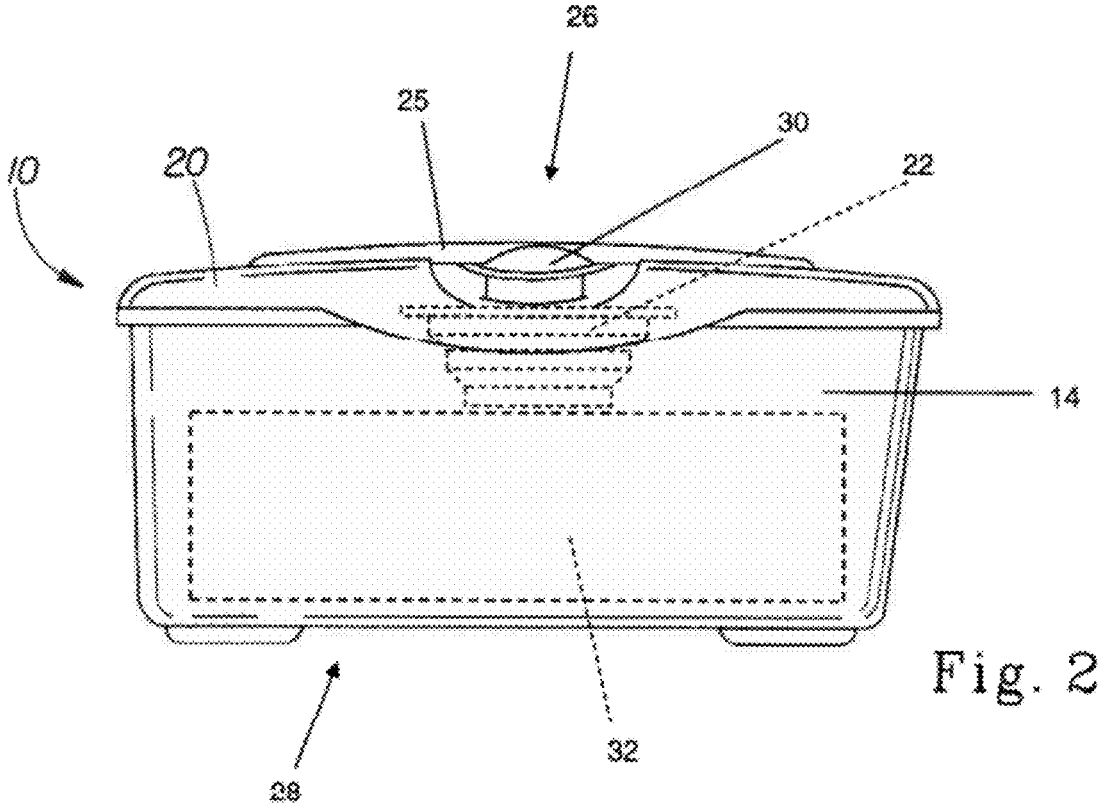
FIG. 2 is a front view of a wipes container.

FIGS. 1 and 2 show a perspective view and a front view, respectively, of a wipes container 10, for storing and dispensing wipes 32. The container 10 may include a top wall 20, a front wall 14, a rear wall 16, and a pair of opposing side walls 18. The container 10 may include a base 12 for providing a relatively stable means of support, for example, when the container 10 is placed on a surface. In certain embodiments, the base 12 may be substantially flat and have a generally rectangular shape. In certain embodiments, the base 12 may include features such as commonly known feet or areas of increased friction. It is to be appreciated, however, that the base 12, one or more of the walls 14, 16, 18, 20 or even the entire container 10 may take any suitable shape desired or include any suitable feature known in the art. The walls 14, 16, 18, and 20 and the base 12 define an interior storage space 2. The interior storage space 2 may be configured to receive one or more wipes 32, for example, in the form of a stack of wipes or a roll of wipes. The interior storage 2 may be sized as desired, for example, to store more than 10, 50, 100, 200, or even more than 500 wipes 32. In certain embodiments, the base 12 and/or one or more of the walls 14, 16, 18, 20 may be separated from one another and/or otherwise manipulated so that a depleted supply of wipes 32 can be replenished. For example, the walls 14, 16, 18, and 20 may be formed as a unitary structure (i.e., formed from a single piece of material or formed from discrete pieces of material and permanently joined together so as to form a single component) and removably joined to the base 12. In this example, the walls 14, 16, 18, and 20 form a top portion 26 of the container 10 and the base 12 forms a bottom portion 28. The top portion 26 of the container 10 may be configured to be lifted off of the bottom portion 28 so that a stack of wipes 32 may be placed on the inner surface of the base 12. The top portion 26 may then be rejoined to the bottom portion 28 after the supply of wipes 32 has been replenished. In certain embodiments, the top wall 20 may be removable and/or repositionable (e.g., by hingedly joining the top wall 20 to one or more of the front, back, or side walls, 14, 16, or 18 and rotating the top wall about the hinge 24). For example, the top wall 20 may be rotated about hinge 24 until there is sufficient space for a user to place a supply of wipes 32 in the interior storage space 2 of the container 10. The top wall 20 may then be returned to its initial position so that the interior storage space 2 is completely enclosed.

The top wall 20 of the container 10 may include an orifice 22 for accessing wipes 32 stored inside the container 10. For example, the orifice 22 may be configured such that a user is able to extract a wipe 32 stored in the container 10 through the orifice 22. While the orifice 22 is shown in FIGS. 1 and 2 as being disposed on the top wall 20, it is to be understood that the orifice may be disposed on any suitable wall 14, 16, and/or 18 as desired. The orifice 22 may be configured as described in more detail hereinbelow. The container 10 may include a lid 25 for covering the orifice 22. The lid 25 may be joined to the top wall 20 and/or the orifice 22 by any means known in the art (e.g., hinge, snap, clasp, plug seal, latches). For example, the lid 25 may include a first fastening component (e.g., male or female component) that is intended to operatively interact with a complementary second fastening component (e.g., male or female component) disposed on the top wall 20 and/or orifice 22, so that the lid 25 may be affixed to the top wall 20 and/or orifice 22. The container 10 may include a means for operating the lid 20, such as a button 30. The button 30 may be operatively engaged with the lid 25 so that when a user properly manipulates the button 30, the lid 25 is repositioned (e.g., opened) to expose the orifice 22. For example, the button 30 may retract and/or reposition a locking arm that resists the force of a lifting mechanism such as a spring or the like. In this example, once the locking arm is properly repositioned, the spring may then apply sufficient force to at least partially open the lid 25. It is to be understood that the actuating means is not limited to a button, but may include any actuating means for opening the lid of a wipes container known in the art.

Figure 3:
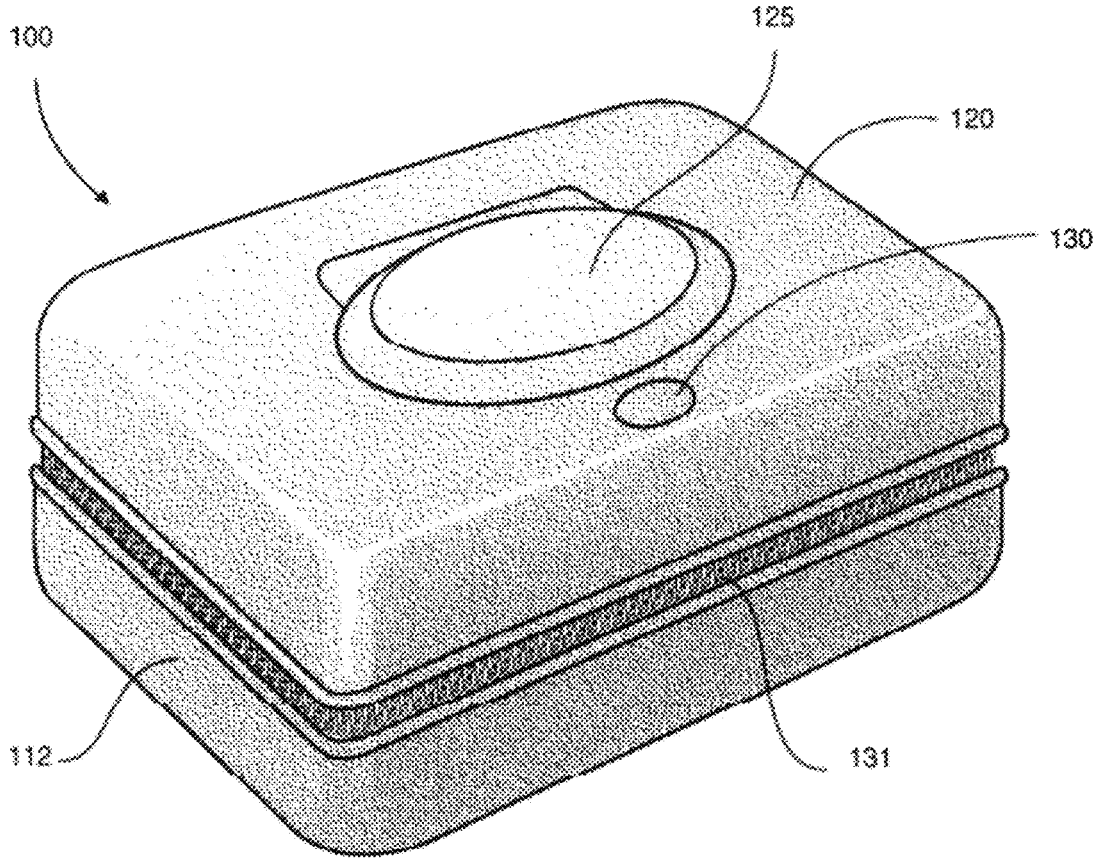
FIG. 3 is a perspective view of a wipes container.
Figure 4:
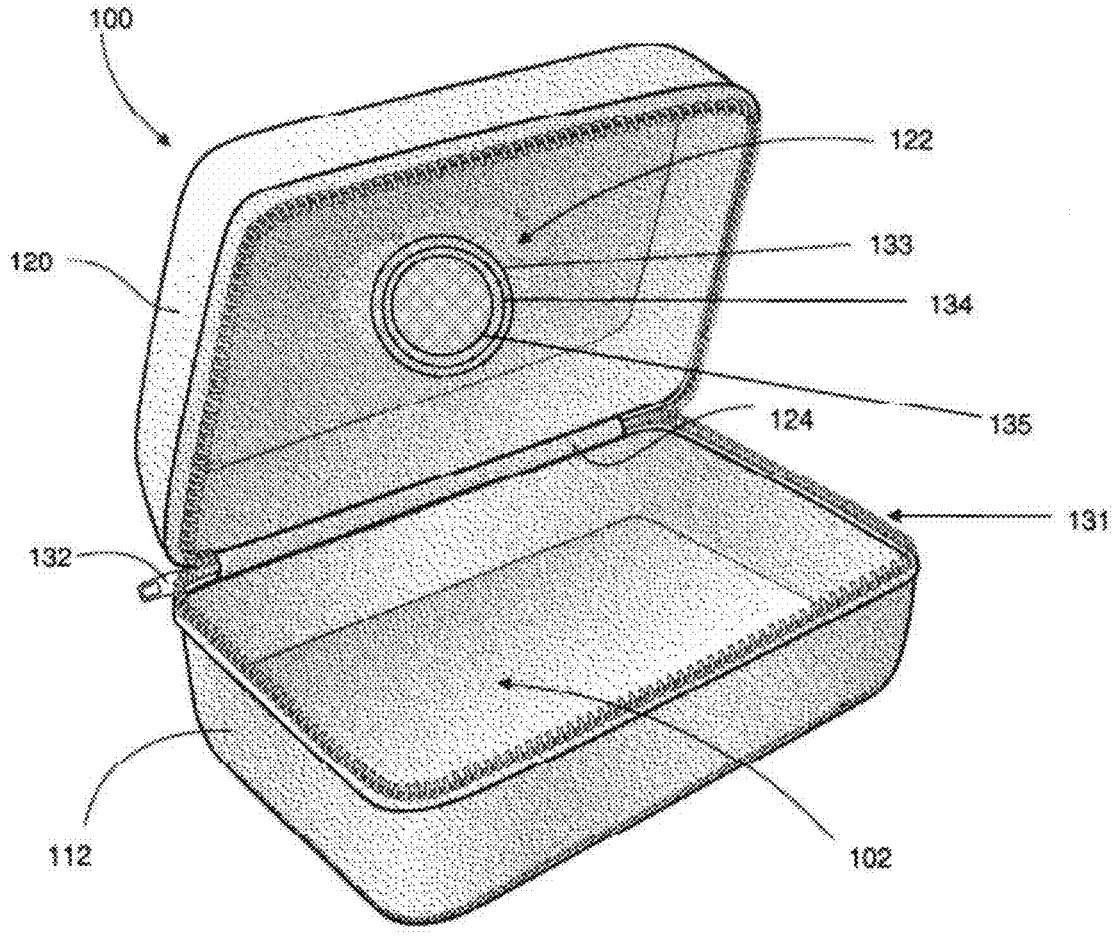
FIG. 4 is a perspective view of a wipes container.
Figure 5:
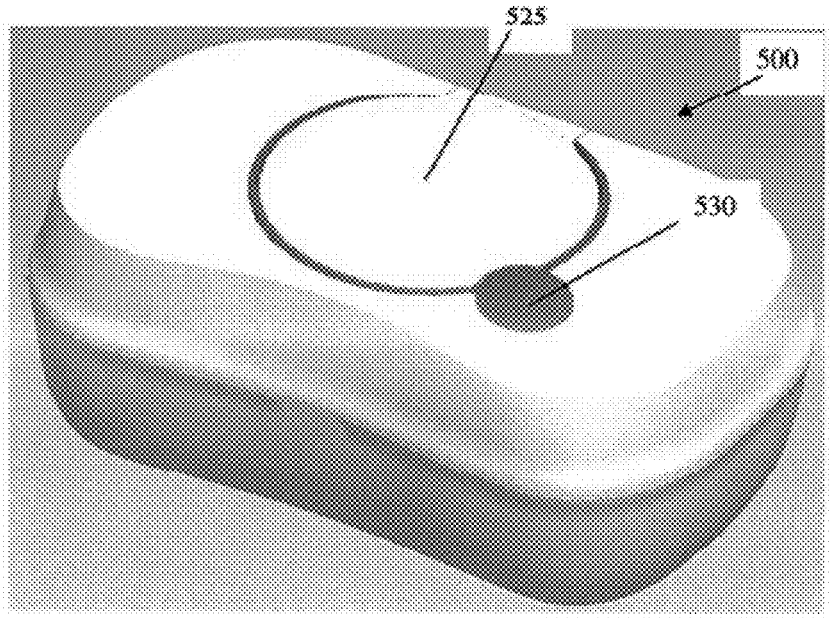
FIG. 5 is a perspective view of a wipes container.
Figure 6:
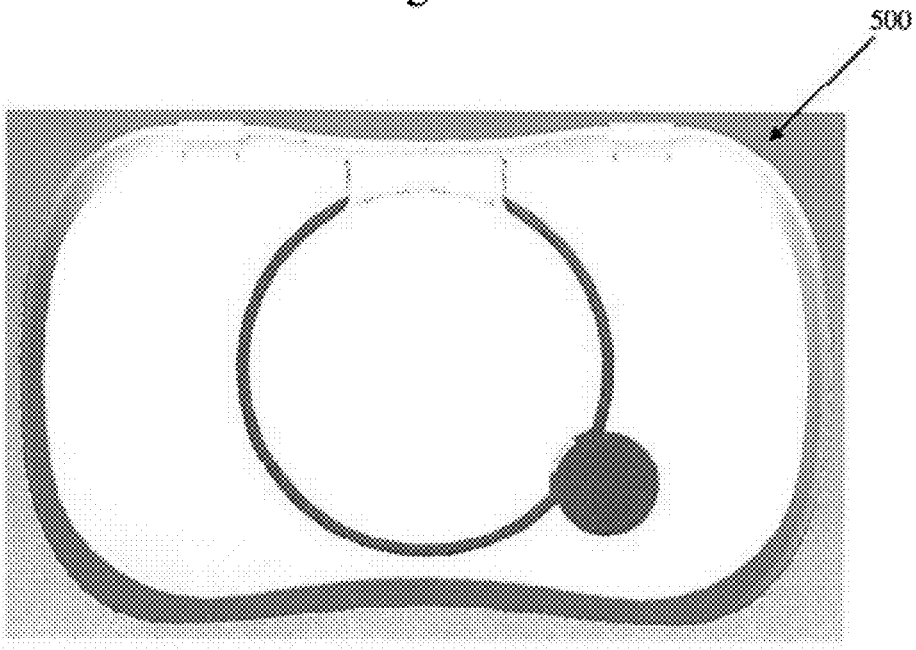
FIG. 6 is a top view of a wipes container.
Figure 7:
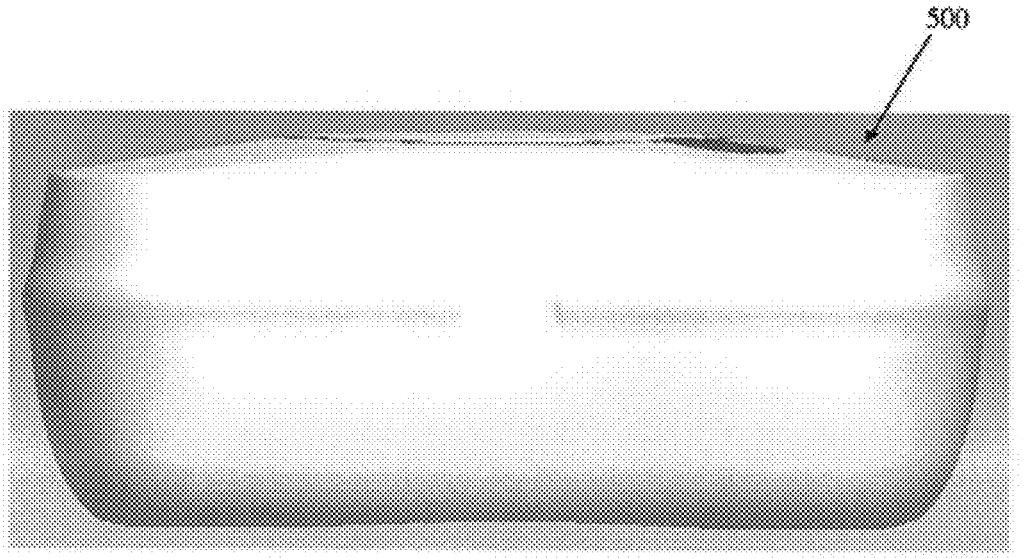
FIG. 7 is a front view of a wipes container.

FIGS. 3 and 4 show perspective views of a container 100 suitable for storing and dispensing wipes. FIG. 3 shows the container 100 in a closed configuration, while FIG. 4 shows the container 100 in an open configuration. The container 100 may include a top shell 120 and a bottom shell 112. The container 100 and/or shells 120 and 112 may be formed from a single piece of material (i.e., unitary) or from two or more discrete pieces of material that cooperatively interact with one another to form an internal storage space 102. The container 100 may be formed by any suitable process known in the art, such as a commonly known blow molding or injection molding process. The top and bottom shells 120 and 112 may be hingedly joined to one another, for example, by hinge 124. Hinge 124 may be a separate component joined to one or both of the shells 120 and/or 112, or hinge 124 may be an integral component formed from the same material and/or at the same time as one or both of the shells 120, 112. In certain embodiments, the hinge 124 may be formed by scoring a portion of a unitary container 100 to create a zone of relative weakness so that the portions of the container on either side of the scored portion (e.g., top and bottom shells 120 and 112) can at least partially rotate about the scored portion. The shells 120 and 112 may be configured to act cooperatively, for example, by rotating at least partially about hinge 124 to form an interior storage space 102 for receiving and storing one or more wipes. It is to be understood, however, that the container 100 need not necessarily include a hinge 124 or, in the alternative, may include more than one hinge 124 (e.g., 2, 3, 4 or more). Embodiments wherein shells 120 and 112 are permanently or temporarily joined to one another by any means known in the art are contemplated herein. In certain embodiments, the shells 120 and 112 may be completely separable from one another. The shells 120 and 112 may be moved relative to one another to define an open (e.g., FIG. 3) and/or a closed (e.g., FIGS. 1-2) position. In certain embodiments, one or both of the shells 120 and/or 112 may have a substantially concave shape or hollow shape, so when the concave or hollow portions of the top and bottom shells 120 and 112 are brought together in a face-to-face relationship an interior storage space 102 is formed therebetween. It is to be appreciated that the shells are not limited to any particular shape (e.g., concave), and that any suitable shape or combination of shapes may be selected, as long as an interior storage is provided for receiving and storing wipes. For example, the container 100 may include a concave shaped top shell 120 and a flat or planar bottom shell 112. When the shells 120 and 112 are brought together in a face-to-face relationship, the shells 120 and 112 may be secured to one another in a closed position through the use of a fastener 131. Fastener 131 may be any fastening means known in the art including, without limitation, mechanical fasteners that have two or more interlocking elements; zippers; buttons; snaps; clasps; straps; belts; pins; magnets; hook/loop type fasteners, hook/hook type fasteners, and tab/slot type fasteners, slide locks, combinations of these and the like. In certain embodiments, the fastener 131 may be provided in the form of a zipper that includes a grasping portion 132.

The wipes container 100 may include one or more orifices 122 for enabling a user to access wipes stored in the interior storage space 102, for example, by dispensing individual wipes through the orifice 122. In certain embodiments, the top shell 120 may include an extendable orifice 122 such as one or more of the extendable orifices 122 described in more detail hereinbelow. The orifice 122 may extend through the top shell 120 to the interior storage space 102. The orifice may include multiple segments 133, 134, and 135 that enable a user to extend and/or collapse the orifice 122, thereby changing the length of the orifice 122. The container 100 may include a lid 125 for covering the orifice 122. The lid 125 may be configured to open and close over the orifice 122 by any means commonly known in the art. It may desirable to provide a convenient means to open the lid 125, for example, by providing an easy-to-push button 130 that actuates the lid 125. The container 100 may include a seal such as a gasket or plug seal around the edge of the lid 125, the orifice 122, the first shell 120, and/or the second shell 112. The lid 125 and seal may function together or independently to extend the useful life of wet-wipes disposed in the interior storage space 102. Suitable examples of lids 125 and seals are described in U.S. Pat. No. 6,910,579, issued on Jun. 28, 2005 to Reinke, et al. Other examples of wipes and wipes container configurations and components are disclosed in U.S. Pat. No. 3,868,052; and U.S. Publication Nos. 2008/0083774; 2008/0222929; 2008/0223868; and 2009/0050504.

The material used to form the containers described herein or any component thereof is not particularly limited; however, it may be desirable to use material that is impermeable to liquid and vapor, for example, when it is contemplated that wet-wipes may stored in the container. Commonly known wet-wipes, which may comprise more than 10%, 25%, 50%, or even 75% by weight of water, based on the weight of the wet-wipes, are stored in the container 10. If a wet-wipe loses too much moisture, it may not provide the desired cleaning benefit, potentially resulting in consumer dissatisfaction with the wet-wipes product. Forming at least part of the container (e.g., one or more walls or portion(s) thereof) from a water and/or vapor impermeable material may at least help reduce the rate and/or amount of moisture lost by the wet-wipes. In certain embodiments, if may be desirable to form a container from a material having a good effusivity. "Effusivity" is the measure of how warm or cold an object or surface feels to a typical human. Generally, a material with a higher effusivity feels colder than a material with a lower effusivity, when both materials are the same temperature. For example, steel has a relatively high effusivity and cotton has a relatively low effusivity. Thus, a cotton object will typically feel warmer than a steel object when both objects are the same temperature. Effusivity is calculated as the square root of the product of the thermal conductivity, density, and heat capacity of the material. Effusivity may be measured (i.e., an Effusivity value is generated) by the method disclosed in copending U.S. application Ser. No. 12/485,073, filed by Gehring on Jun. 16, 2009 (Sensory Warmth Test). Suitable Effusivity values are less than 550, for example, from 100 to 400 or 200 to 300, when determined according to the Sensory Warmth Test. Certain foamed ethylene vinyl acetate materials may be suitable for providing a wipes container with a desirable Effusivity value.

Figure 8:
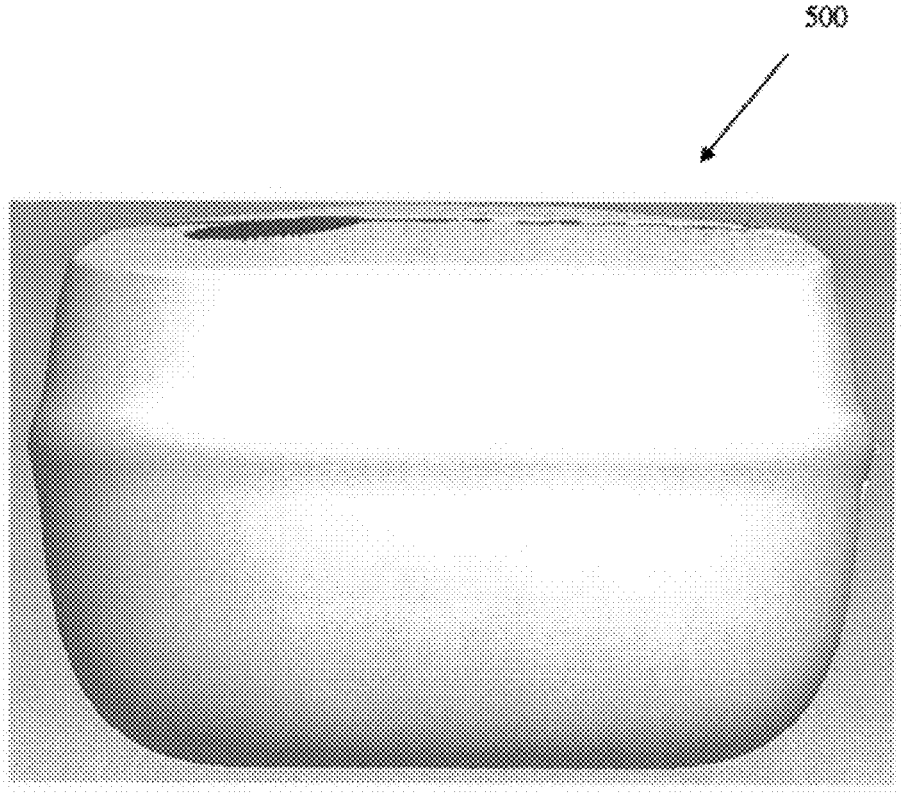
FIG. 8 is a side view of a wipes container.

FIGS. 5-8 show an example of a suitable design for a wipes container 500, as described herein. The wipes container 500 may include a lid 525 and a means for actuating the lid, such as button 530. The wipes container 500 may be configured to have rounded edges that appear soft, as opposed to the sharp and/or pointed edges that are sometimes present in conventional wipes containers. While only one side view of the container 500 is shown in FIG. 8, it is to be understood that the opposite side appears substantially identical to the side shown in FIG. 8.

Extendable Orifice

Providing a wipes container with an extendable orifice may provide at least some advantages over conventional wipes containers. Specifically, an extendable orifice may make it easy for a user to extract a wipe that has fallen back into the container; reduce the occurrence of fall-back; reduce moisture loss from wet-wipes; and/or provide a suitable storage space for undesired wipes after a chaining event (i.e., when two or more wipes fail to separate from one another as intended and one or more of the additional wipes are dispensed through the orifice). For example, the orifice may be extended such that it is positioned proximate to or even contacting wipes in the container. In this example, the inner surface of the extended orifice (i.e., the surface facing the user and/or external environment) may form a cup-like structure or concavity into which the hand of a user passes when the user attempts to access wipes stored in the container. While there is no particular limit on the size or dimensions of the orifice, it may be desirable to configure the orifice to accommodate a range of hand sizes. By extending the orifice so that it is proximate to the wipes stored in the container or even contacting the wipes in the container, the occurrence of fall-back may be reduced since the wipe essentially has no where to fall back to. If a chaining event occurs, one or more of the undesired wipes may be placed in the cup-like structure formed by the extended orifice. Placing one or more wipes in the extended orifice may provide a convenient way to store wipes for later use without the need to place the wipe(s) on a potentially dirty surface. In certain embodiments, a lid may be closed over the orifice and the cup-like structure where a wet-wipe(s) has been placed to help keep the wet-wipe from drying out. When a wet-wipe is placed in the cup-like structure formed by the orifice, the wet-wipe may at least help reduce the rate and/or amount of moisture loss that occurs through the orifice.

In certain embodiments, it may be desirable to provide a wipes container in which the extendable orifice provides a user with an indication of how many wipes are remaining in the container. For example, when a supply of wipes is replenished (e.g., by placing a new cartridge of wipes in the container), the top of the wipe stack may come up to the bottom of the extendable orifice when the orifice is in a fully collapsed configuration. However, as the supply of wipes is depleted and a user extends the orifice into the container to maintain a desirable position with respect to the top of the stack of wipes, an indication of how many wipes remain in the container may be provided to the user (e.g., if the orifice is extended about halfway, then only about half the wipes remain). When the supply of wipes of almost depleted, the orifice may be fully or almost fully extended, thereby indicating to a user that the supply of wipes is almost depleted. In this example, it may be desirable to provide an extendable orifice which is capable of extending to 2×, 3×, 4× 5×, 6×, 7×, 8×, 9×, 10× or more than its fully collapsed length.

In certain embodiments, the extendable orifice may be extended to reduce the available free volume of the interior storage space of the container. As mentioned previously, some wipes include volatile compositions and/or water. The amount of available space as well as the amount of exposed surface area of the volatile composition or water is known to impact the rate at which such materials evaporate. Whenever a wipes container is opened, any water vapor or volatile composition present in the interior storage space of the container may have an opportunity to escape. Thus, reducing the amount of free space in the container may reduce the amount and/or rate of evaporation of water or volatile composition present on/in the wet-wipes. Similarly, reducing the amount of exposed surface area of the wet-wipes may reduce the amount and/or rate of evaporation of water or volatile composition present on/in the wet-wipes. To this end, the extendable orifice may be extended to cover at least a portion of the surface of the upper-most wet-wipe disposed in the container, thereby reducing the exposed surface area of the wet-wipes and/or the volume of the internal storage space of the container. For example, the orifice may be capable of reducing the internal volume of the container by up to 100% (i.e., the orifice is capable of occupying all of the internal storage space of the container); from 5-95%; 10-80%; 25-50%; 30-40%; or any value in these ranges. A wipes container that includes an extendable orifice may reduce moisture loss from wet-wipes as compared to a container that does not include an extendable orifice over the course of the typical lifetime of a supply of wipes (e.g., 1, 2, 3, or even 4 weeks).

The extendable orifice may include two or more segments that are configured to operatively provide an extension means. The number of segments included in an extendable orifice is not particularly limited and may be based on a variety of considerations such as, for example, the depth of the container, material cost, the number of wipes typically stored in the container at any given time, the ease with which the orifice can be extended, etc. The segments may be formed as a unitary structure or as several discrete components joined together, for example, by foldable material portions. The segments may be individually extendable. That is, each segment may be capable of being extended independent of whether any other segments are extended. For example, if an extendable orifice includes three individually extendable segments, then the first, second, and/or third segment may be extended independent of whether the first or second segments are extended. However, it is to be appreciated that in certain embodiments, the uppermost segment in the extendable orifice (i.e., the segment farthest from the wipes when the orifice is fully extended) may not be extendable, as this segment may be joined to the container and/or be the segment into/onto which some or all of the other segments, directly or indirectly, collapse. Thus, in order to extend the orifice, at least one segment other than the uppermost segment may need to be extended. In certain embodiments, the extendable orifice may include one or more segments that are not individually extendable (i.e., one or more other segments must be extended before or simultaneous with the non-independently extendable segment). For example, if an extendable orifice includes three non-independently extendable segments, then it may be necessary to extend the first segment before or simultaneously with the second and/or third segments. Similarly the second segment must be extended prior to or simultaneously with the third segment.

In certain embodiments, the orifice may include segments that function in a manner sometimes referred to telescoping. That is, the segments are arranged in succession so that each successive segment is capable of passing into the preceding segment(s). Thus, a telescopically extendable orifice has a collapsed length (i.e., the length of the orifice when in a fully collapsed configuration) equal to the length of the longest segment. A telescopically extended orifice has a longest dimension orthogonal to the direction of extension that generally decreases over the length of the orifice (i.e., the orifice generally has a tapered appearance). For example, if the orifice has a circular cross-sectional shape, then the diameter of each succeeding segment may be less than the preceding segment(s). If the orifice has a square or rectangular cross-sectional shape, then the distance between opposing sides may decrease for each succeeding segment. "Succession," "succeeding," and variations of these terms refer herein to the arrangement of the segments of an extendable orifice when the orifice is extended. Where a second segment succeeds a first segment, the second segment extends further into the container than the first segment and the first segment is closer to the wall to which the orifice is joined. However, it is to be appreciated that while some embodiments herein may describe that orifice as being tapered in from top to bottom (i.e., succeeding segments get smaller), embodiments wherein the orifice is tapered from bottom to top (i.e., succeeding segments get larger) are also contemplated herein.

In certain embodiments, the orifice may be arranged like a bellows. That is, the orifice may have two or more segments arranged in succession, which are substantially the same size throughout the length of the orifice. In a bellow-like configuration, the orifice may employ a commonly known corrugated or pleated structure to provide extension. A corrugated or pleated structure typically includes a series of alternating peaks and valleys, which generally alternate along the length of the orifice. Thus, if the extendable orifice has a circular cross-sectional shape, then the peak-to-peak and valley-to-valley diameter of each succeeding segment is substantially the same as the peak-to-peak and valley-to-valley diameter of the preceding segment(s). Similarly, if the orifice has a square or rectangular cross-sectional shape, then the peak-to-peak and valley-to-valley distance between opposing sides of the square or rectangle do not substantially decrease for each succeeding segment. It is to be understood that, when the orifice includes a bellows-like configuration, the segments of the bellows are, ideally, the same size, but in practice the segments may exhibit some variation in size without departing from the scope of the disclosure herein. In a bellows-like configuration, the collapsed length of orifice is a function of the thickness of the material(s) used to make the orifice. In certain embodiments, the extendable orifice may be configured to include both telescoping and bellows-like mechanisms of operation.

The material used to construct the orifice is not particularly limited; however, it may be desirable to select a material that is pliable and that is capable of forming a good seal with a wipes container. Generally, the more pliable or rubbery the orifice material is, the easier it is to extend and/or collapse the extendable orifice. However, if the material is too pliable, then the orifice may not function as desired. For example, the orifice may undesirably collapse when a wipe is extracted and/or the orifice may not provide sufficient dispensing force to reduce or prevent chaining and/or fall-back. It may also be desirable to select a material that promotes or at least does not inhibit condensation of water vapor on the surface of the orifice. In this way, water vapor that condenses on the surface of the extended orifice may travel back down the orifice and be deposited onto the wet-wipes, which helps keep at least the uppermost wipe(s) in the container relatively moist and suitable for use. It may further be desirable to select or modify the material used to form the orifice to have portions that at least help perform a particular function. For example, one or more portions of the outer surface of the orifice, which face toward the interior storage space of the wipes container, may be modified or selected to have one or more rough portions that increase the frictional force between this surface of the orifice and a wipe being extracted through the orifice. Thus, the dispensing force of the orifice may be altered by providing surface features, for example, to the bottom, outer surface of the orifice. In certain embodiments, one or more surfaces of the orifice or portions thereof may be coated with a material to increase the coefficient of friction of the surface or surface portion. It is believed, without being limited by theory, that providing a suitable dispensing force plays an important role in consumer satisfaction with a wipes container in the context of "one-handed operation" (i.e., the ability of a user to access and extract a wipe from a wipes container using only one hand. For example, if the dispensing force is too high, lift-off may occur, and if the dispensing force is too low, chaining may occur.

The extendable orifice may include a trunk and an aperture. The trunk defines the physical shape and structure of the orifice, and is the portion of orifice that extends into the interior storage space of the container. The trunk may include an outer surface, which is substantially contiguous with the interior storage space of the wipes container, and an inner surface, which is substantially contiguous with the external environment. The trunk may be configured to be partially or fully extended to any suitable length desired. For example, the trunk may extend up from between 10% and 100%, 25-75%, or any value less than 100% but greater than 0%, of the distance between opposing walls of the container (e.g., the top and bottom walls). The aperture provides an opening in the bottom of the trunk (i.e., the portion of the trunk closest to wipes when the trunk is extended) through which wipes may be dispensed. The shape of the aperture is not particularly limited and may include, without limitation, shapes; lines; animals; letters; symmetric or asymmetric patterns; characters; objects; and combinations of these. It may be desirable to select an aperture shape that performs a particular purpose. For example, the aperture shape may be selected to alter the dispensing force of the orifice, and/or the aperture shape may be selected to minimize the amount of open area to help reduce moisture loss.

In certain embodiments, an extendable orifice may be removable, reattachable and/or transferrable. While embodiments wherein the extendable orifice is permanently joined to a container by any means known in the art (e.g., adhesive or thermal bonding) are contemplated herein, it may be desirable to reuse an extendable orifice. For example, an array of extendable orifices that are configured to fit on a particular brand of wipes containers may be provided, where each orifice provides a different aesthetic (e.g., color, shape, design, character, animal, object, combinations of these and the like) and/or function (e.g., increased/decreased dispensing force, reduced moisture loss, increased capacity to store wipes, combinations of these and the like). Thus, when a consumer purchases a new container for storing and dispensing wipes, the consumer may replace the extendable orifice with another.

In certain embodiments, the orifice may be affixed to a fitment on a package of wipe intended to be used as a refill cartridge. For example, refill cartridges of wipes are commonly known to come in plastic packages, sometimes referred to as "flow wrap" packages, and have a rigid plastic fitment that typically functions as a sort of lid or cover for the opening in the refill cartridge, so that the refill cartridge of wipes may be used as a stand-alone package (i.e., not placed in a reusable/refillable container). The extendable orifice may be removably joined to the fitment so that the fitment and the orifice may be transferred to another container, e.g., a reusable container. For example, the orifice may be configured to extend through the opening in the top of the container, and the fitment may be configured to function as a lid for the container, covering the orifice.

Figure 9A:
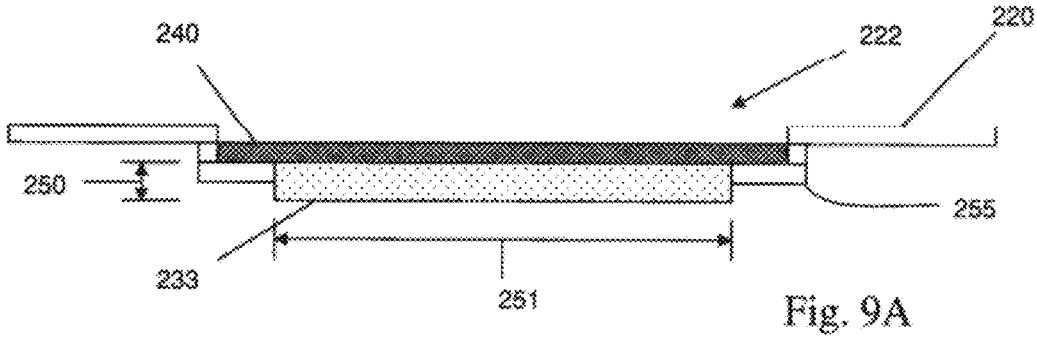
FIGS. 9A-9C are side views of an extendable orifice in various stages of extension.
Figure 9B:
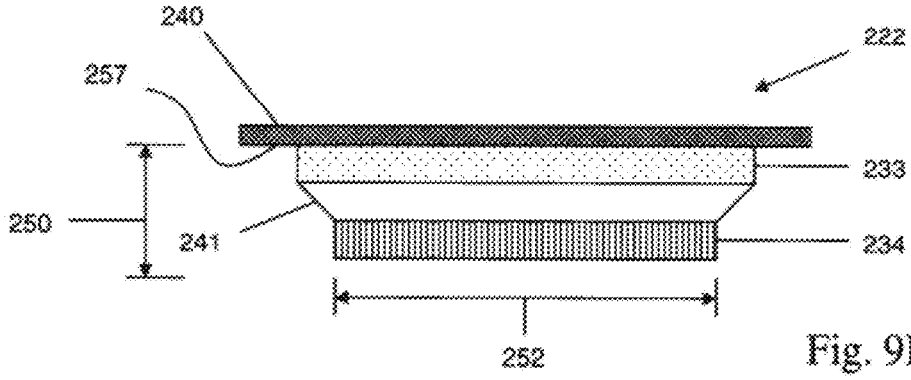
Figure 9C:
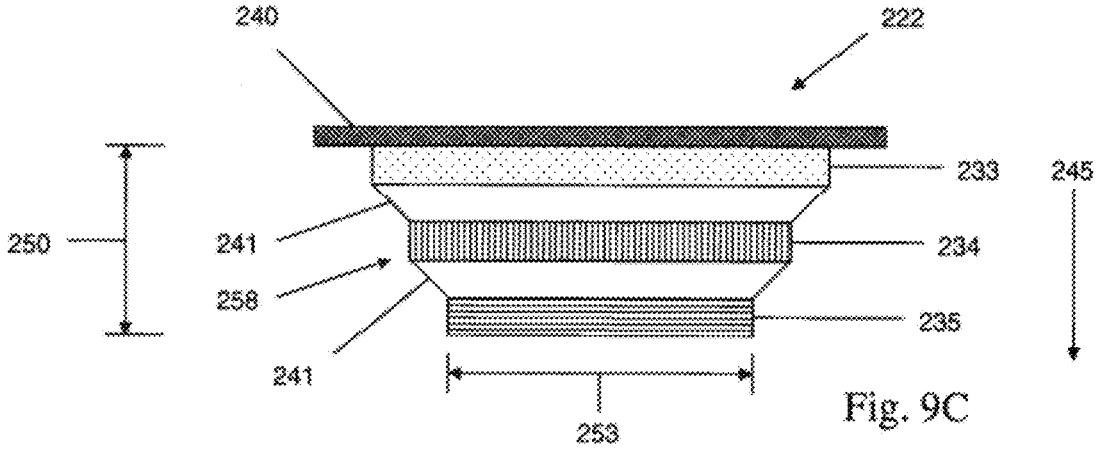
Figure 10:
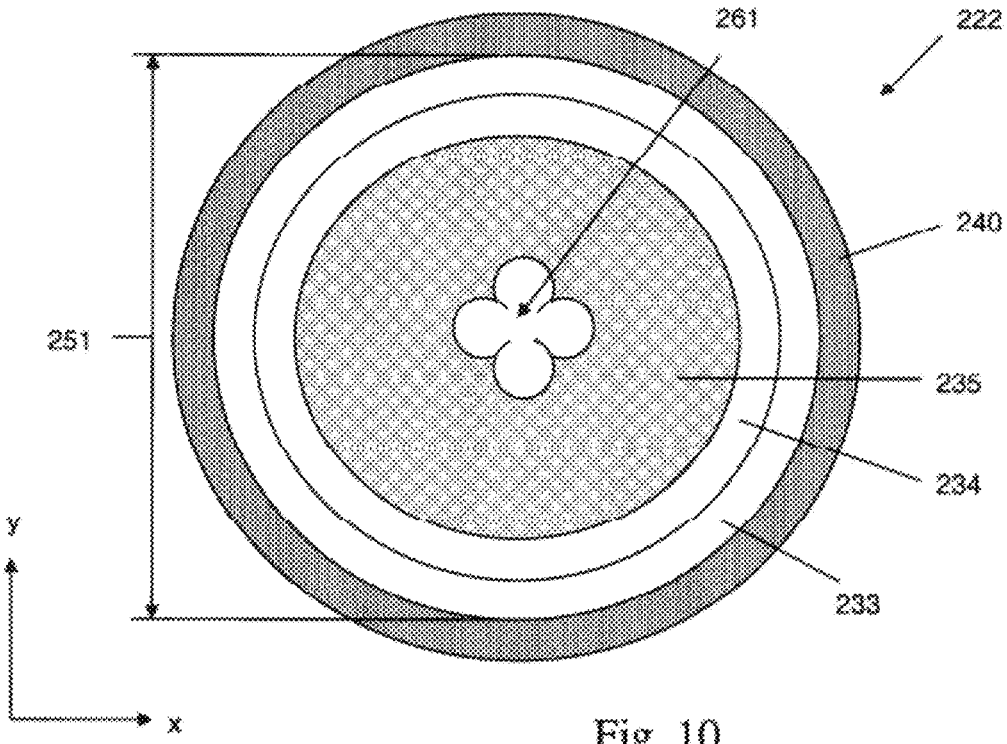
FIG. 10 is a top view of an extendible orifice.

FIGS. 9A-9C show an exemplary orifice 222 for use with a wipes container such as one or more of the wipes containers described herein. The orifice 222 may be configured as a telescopically extendable orifice 222 including a first segment 233, a second segment 234, and a third segment 235. The second segment 234 may be configured to extend out of and collapse into the first segment 233. Similarly, the third segment may be configured to extend out of and collapse into the first and/or or second segments 233 and/or 234. In FIG. 9A, the orifice 222 is shown as being fully collapsed (i.e., the second and third segments are both collapsed into the first segment). The orifice 222 generally has an x-y plane, as shown in FIG. 10, and an axial direction 245 orthogonal to the x-y plane, as shown in FIG. 9C. The orifice 222 may include an edge 240 that extends radially outward from the first segment 233 in the x-y plane. The extended edge 240 of the orifice 222 may be configured to provide a means for properly positioning and/or maintaining the position of the orifice 222 in a container. For example, the extended edge 240 of the orifice 222 may be positioned in an overlying relationship with a complementary extending edge 255 present in the top wall 220 of a container. In such a configuration, the orifice 222 may be supported by the top wall 220 of the container, while the remaining portion(s) of the orifice 222 extend past the top wall 220 and into the container. The orifice 222 has a length 250, measured as the distance from the bottom side 257 of extended edge 240 to the bottom side of the lowest extending portion of the orifice 222 in the axial direction 245. In FIG. 9A, the length 250 of the orifice 222 corresponds to the length 250 of the first segment 233, which is the distance from the bottom side 257 of the extended edge 240 to the bottom side of the first segment 233. Each segment 233, 234, and 235 of the orifice 222 has a width 251, 252, and 253, respectively, determined as the distance between two opposing points lying in the same cross-sectional plane of the segment 233, 234, 235. For example, in embodiments where the orifice 222 has a circular cross-sectional shape, the width of a segment 233, 234, 235 is the diameter of the circular cross-section of the segment 233, 234, 235. It is to be appreciated that the orifice 222 shown in FIGS. 9A-9C may include an inner surface (e.g., inner surface 456 shown in FIG. 12), an outer surface 258, and some thickness that separates the inner and outer surfaces 456 and 258. The width of a segment 233, 234, 235 is determined between opposing points located on the outer surface 258 of the orifice 222. The segments 233, 234, and 235 may be joined to one another by a foldable portion 241. The foldable portion 241 may be formed from the same material as one or more of the segments 233, 234, and 235, but need necessarily be so. The foldable portion(s) 241 and/or the material from which the foldable portion(s) 241 is made may be sufficiently pliable to enable the orifice 222 to desirably collapse, yet be resilient enough to maintain the orifice 222 in an extended configuration when wipes are extracted through the orifice 222.

FIG. 9B shows the orifice 222 in a partially extended configuration. The second segment 234 extends out of the first segment 233, but the third segment 235 is still collapsed into the second segment 234. As shown in the FIG. 9B, the second segment 234 has a width 252, which is less than the width 251 of the first segment 233, and the orifice 222 has a length 250, which is the distance from the bottom side 257 of the extended edge 240 to the bottom side of the second segment 234.

FIG. 9C shows the orifice 222 in a fully extended configuration. The second segment 234 extends out of the first segment 233 and the third segment 235 extends out of the second segment 234. As shown, in FIG. 9C, the third segment has a width 253 which is less than the width of the first and second segments 233 and 234, and the orifice 222 has a length 250, which is the distance from the bottom side 257 of the extended edge 240 to the bottom side of the third segment 235.

FIG. 10 shows a top view of the orifice 222 of FIGS. 9A-9C. The orifice 222 has an x-y plane and, in this example, the x-y plane defines a circular cross-sectional shape. The orifice 222 may include an aperture 261, through which wipes can be extracted.

Figure 11A:
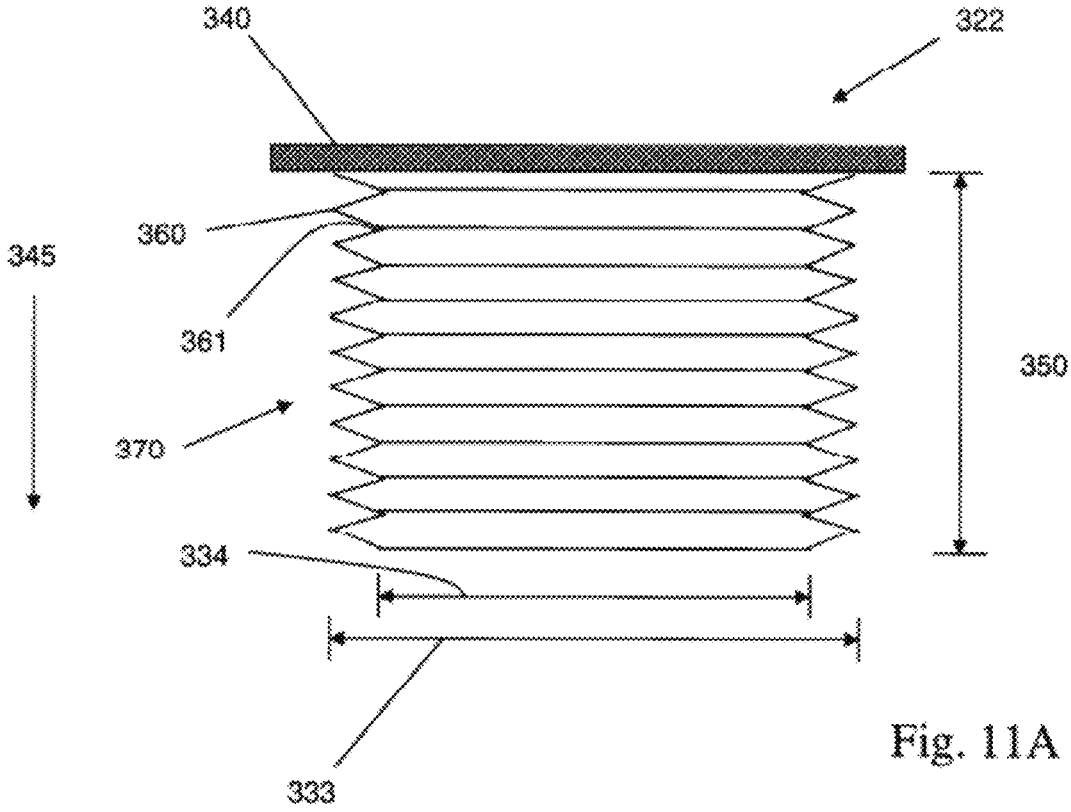
FIGS. 11A-11B are side views of an extendible orifice.
Figure 11B:
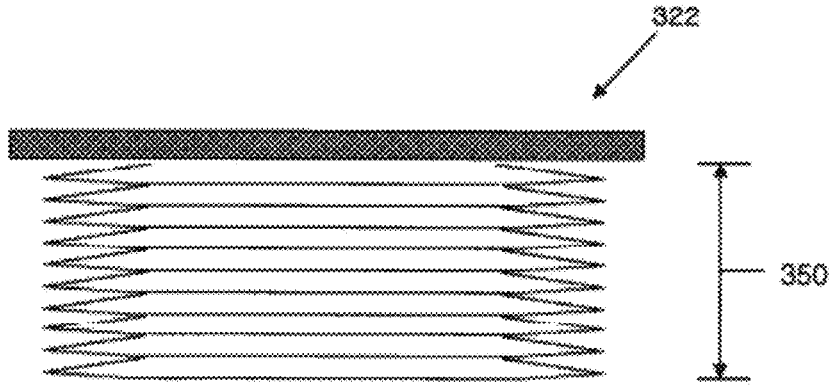

FIGS. 11A and 11B show another example of an extendable orifice 322 suitable for use herein. The orifice 322 may include a trunk 370 comprising a series of alternating peaks 360 and valleys 361. The alternating peaks and valleys form a corrugated structure in the axial direction 345, which enables a user to extend and/or collapse the orifice 322. The orifice 322 may include an edge 340 that extends radially outward from the trunk 370 for affixing the orifice 322 to a container, for example, by placing the extending edge 340 in an overlying relationship with a complementary edge on a container. The orifice 322 has a length 350 in the axial direction 345, a peak-to-peak width 333 (i.e., the radial distance between opposing peaks), and a valley-to-valley width 334 (i.e., the radial distance between opposing valleys). FIG. 11A shows the extendable orifice 222 in an extended configuration. FIG. 11B shows the extendable orifice 22 in a collapsed configuration. As can be seen in FIGS. 11A and 11B, the length 350 of the trunk 370 may change when going from the extended to collapsed configuration, but the widths 333 and 334 remain substantially unchanged.

Figure 12:
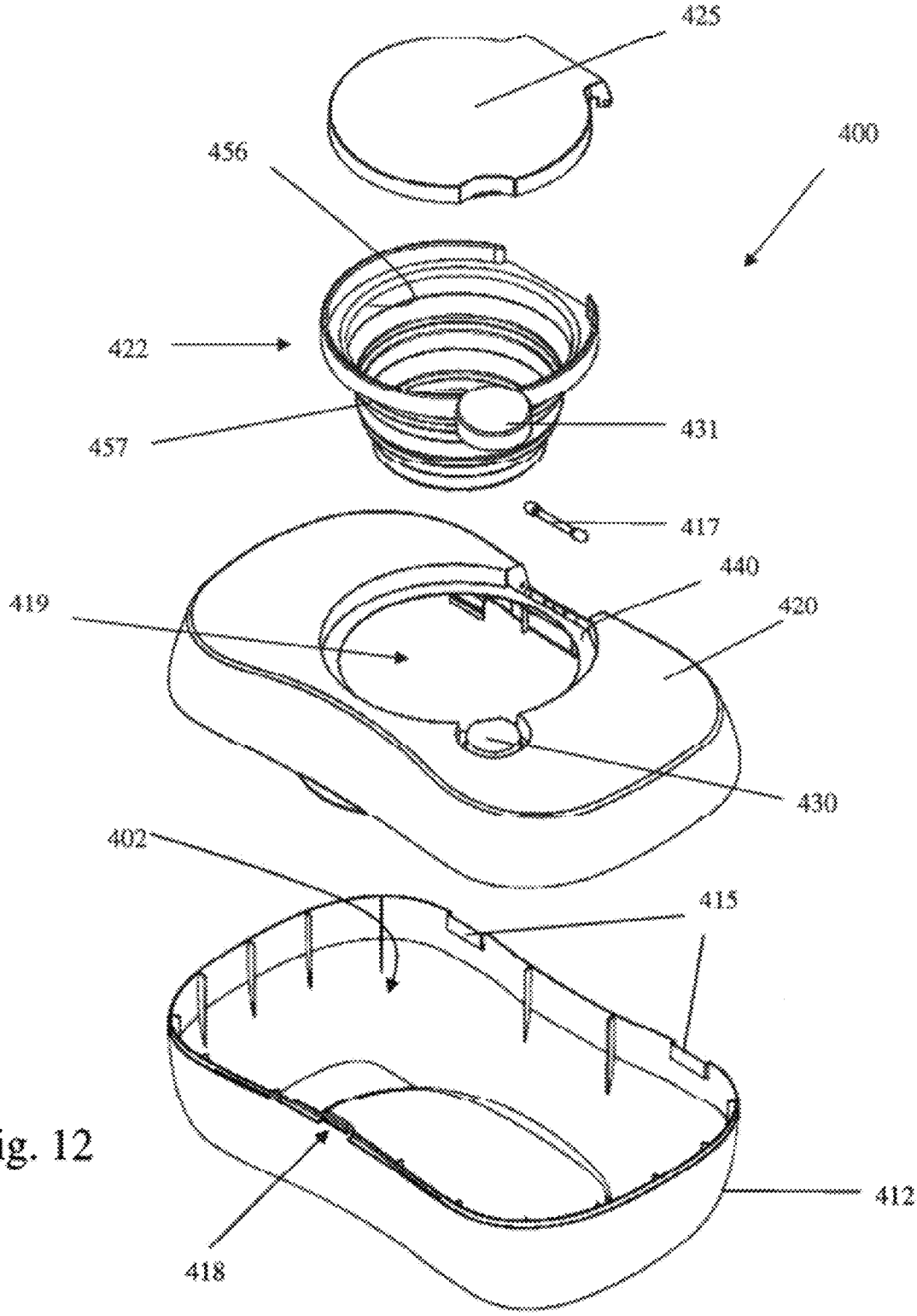
FIG. 12 is an exploded view of a wipes container.

FIG. 12 shows an exploded view of an example of wipes container 400 suitable for use herein. The container 400 may include a first shell 420 and a second shell 412. The first and second shells 420 and 412 may be joined to one another, for example, by the hinges 415 disposed on the back side of the shell(s) 420 and/or 412 and/or the clasp 418 disposed on the front side of the shells 412, 420. The first and second shells 420 and 412 may have a substantially hollowed-out shape, so that when they are brought together in a face-to-face relationship an interior storage space 402 is defined. The container 400 may include an opening 419 that extends through the first shell 420. The container 400 may include an extendable orifice 422 that is configured to be placed on an extended edge 440 of the container 400 (i.e., a portion of the orifice 422 has a diameter greater than the diameter of the opening 419 and may be placed in an overlying relationship with the extended edge 440). The remaining portion of the orifice 422 may extend through the opening 419 and into the interior storage space 402. The extendible orifice 422 includes an outer surface 457 and an inner surface 456. The container 400 may include a lid 425 configured to at least partially cover the opening 419 and the orifice 422. The lid 425 and/or the orifice 422 may include a means for joining the lid 425 and the orifice 422 to one another. The lid 425 may be actuated by an actuating means such as, for example, the combination of a button 430 and a dog bone spring 417 wherein the button 430 operatively acts to enable potential energy stored in the spring 417 to at least partially open lid 425. The extendible orifice 422 may include a button cover 431 configured to modify the aesthetic and/or surface texture properties of the button 430. For example, button cover 431 may provide a different color so that the button is easier or harder to see. In another example, the button may include one or more rough portions to increase the frictional force between the button 430 and the skin of a user, thereby potentially increasing the ease of one-handed opening of the container 400.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container for storing and dispensing wipes, the wipes container comprising:
   an interior storage space for storing one or more wipes;
   one or more wipes disposed in the interior storage space; and
   an extendable orifice for enabling a user to access the wipes, the extendable orifice comprising an x-y plane and two or more foldable segments, wherein the orifice is extendable into the interior storage space of the wipes container in an axial direction which is substantially orthogonal to the x-y plane.

2. The wipes container of claim 1, wherein the extendable orifice is collapsible.

3. The wipes container of claim 1, wherein the extendable orifice comprises a first segment and a second segment, each segment having a longest dimension in the x-y plane of the orifice.

4. The wipes container of claim 3, wherein the longest dimension of the second segment is less than the longest dimension of the first segment.

5. The wipes container of claim 3, wherein the longest dimension of the second segment is substantially the same as the longest dimension of the first segment.

6. The wipes container of claim 1, wherein the extendable orifice comprises three or more segments in succession, each segment having a longest dimension in the x-y plane of the orifice, the longest dimension of any segment in the succession being not greater than the longest dimension of a segment that precedes it in the succession.

7. The wipes container of claim 1, where the orifice has an extended length and a collapsed length, the extended length being greater than the collapsed length.

8. The wipes container of claim 1, wherein the orifice is extendable such that a cup-like space is provided in the orifice, the cup-like space being suitable for storing one or more wipes.

9. The wipes container of claim 8, wherein the container includes a lid and the lid covers the orifice and the cup-like space when a wipe is stored in the cup-like space.

10. The wipes container of claim 1, wherein the orifice does not collapse when the wipes are extracted from the container.

11. The wipes container of claim 1, wherein the container exhibits substantially no lift-off when the wipes are extracted.

12. The wipes container of claim 1, wherein at least a portion of the extendable orifice includes surface features for increasing the dispensing force of the container.

13. The wipes container of claim 1, wherein the interior storage space has a volume, the volume of the interior storage space being reduced by an amount in the range of about 5% to about 100% when the extendable orifice is extended.

14. The wipes container of claim 1, wherein the orifice is at least one of removable, reattachable, and transferable.

15. The wipes container of claim 1, further comprising a lid for covering the extendable orifice.

16. The wipes container of claim 15, wherein the orifice is at least one of removable, reattachable, and transferable.

17. The wipes container of claim 1, wherein the wipes are wet-wipes and the wipes container reduces the amount of moisture loss of the wet-wipes.

18. The container of claim 1, wherein the container has an Effusivity value at 23° C. and 32° C. of less than about 550.

19. The container of claim 1, further comprising one or more rigid walls.

20. A reusable container for storing and dispensing wet-wipes, the wipes container comprising:
   a first shell joined to a second shell by a hinge, the first and second shells defining an interior storage space for storing one or more wipes;
   a plurality of wet-wipes disposed in the interior storage space;
   a telescopically extendable orifice comprising two or more foldable segments joined to the first shell of the container, wherein the orifice is extendable into the interior storage space of the wipes container, the extendable orifice enabling a user to access and remove at least one wet-wipe from the interior storage space; and
   a lid joined to the first shell for covering the orifice; wherein the container can be opened by a user to replenish a depleted supply of wet-wipes in the interior storage space by rotating at least one of the first and second shells about the hinge.

* * * * *